United States Patent [19]

Graf

[11] 4,155,379

[45] May 22, 1979

[54] HEDDLE FOR A WEAVING MACHINE

[75] Inventor: Martin Graf, Horgenberg, Switzerland

[73] Assignee: Grob & Co. Aktiengesellschaft, Horgen, Switzerland

[21] Appl. No.: 882,156

[22] Filed: Feb. 28, 1978

[30] Foreign Application Priority Data

Feb. 28, 1977 [CH] Switzerland ..... 2487/77

[51] Int. Cl.[2] ..... D03C 9/02; D03C 9/04

[52] U.S. Cl. ..... 139/93; 139/96

[58] Field of Search ..... 139/91–96, 139/368

[56] References Cited

U.S. PATENT DOCUMENTS

| | | | |
|---|---|---|---|
| 3,304,957 | 2/1967 | Koch | 139/93 |
| 3,948,296 | 4/1976 | Koch | 139/91 |

FOREIGN PATENT DOCUMENTS

| | | | |
|---|---|---|---|
| 2610311 | 9/1977 | Fed. Rep. of Germany | 139/92 |
| 1056229 | 1/1967 | United Kingdom | 139/93 |
| 1212774 | 11/1970 | United Kingdom | 139/95 |

*Primary Examiner*—James Kee Chi

*Attorney, Agent, or Firm*—Watson, Cole, Grindle & Watson

[57] ABSTRACT

The heddles of a weaving machine have vibration absorbing material on the end loops thereof which normally contact edges of metal rods mounted on a heddle frame for oscillating movement, the heddles effecting a lifting movement relative to the rods upon oscillation thereof. Metal-to-metal contact between the end loops and the rods is therefore avoided so as to reduce noise during operation of the machine and so as to avoid corrosion of the heddles and the rods.

5 Claims, 26 Drawing Figures

HEDDLE FOR A WEAVING MACHINE

BACKGROUND OF THE INVENTION

This invention relates to a heddle having a metallic shaft and end loops that serve to hold the heddle on the heddle carrying rods of a heddle frame, the oscillating movement of which causes the heddle to make a lifting movement relative to the heddle carrying rods and to hit one or the other of its end loops against at least one of the heddle carrying rods.

The hitting of the end loops, particularly against the edges of the heddle carrying rods, at each up-and-down movement of the heddle frame, is one of the many sources of noise on a weaving machine responsible for the noise prevailing in a weaving shed.

SUMMARY OF THE INVENTION

One of the principal objects of the present invention is to reduce the noise and furthermore to increase the life expectancy and range of application through a far-reaching prevention of corrosion. Corrosion occurs particularly at the end loops of a heddle due to the continuous hitting together of metallic parts and is generally sped up due to the humidity in a weaving shed, but mainly when the heddles are working on weaving machines with hydraulic weft insertion. The rust forming in this way may flake off and the fine particles may fall into the woven fabric making it unfit for use.

In order to meet the above-mentioned objectives, the main characteristic of the present heddle is that each of its end loops will have vibration absorbing material at least on those parts coming in contact with the edges of the heddle carrying rods. Preferably, this material will be of plastic. In order to achieve a noise abatement, it will suffice if one metallic end loop of a heddle having a metallic shaft is covered with plastic material at least on the inner side located at the axis of the heddle. There will thus be no contact of metal on metal when the end loop hits the heddle carrying rod.

Preferably the heddle shaft end is connected with an end loop made of plastic material and, in fact, one end loop can either be of plastic material sprayed on the shaft end of a heddle by using an injection mold. However, it can also be a separately manufactured end loop of plastic material which can be connected to the end of the heddle shaft by glueing, fastening or by means of ultrasonic welding. With the end loop made entirely of plastic material not only the abatement of noise, but also the prevention of corrosion is achieved in the most optimal manner.

In a preferable arrangement, the end of the heddle shaft which serves for the connection extends over the length of the end loop until very close to its outer edge in its longitudinal axis. The end of the heddle shaft which reinforces the end loop in its back section in the direction of the heddle axis has changes in the cross-section at consecutive intervals such as for instance, recesses or notches in the edge which, for the purpose of anchoring of the end loop at the end of the heddle shaft, are filled with plastic material whereby these recesses could be holes or slots. The end loop, which is injection molded on the end of the heddle shaft, is firmly secured by the plastic material filling these recesses.

Furthermore, the end loop can also be placed off-center at the end of the heddle shaft, whereby three sides of the end of the heddle shaft will be embodied in plastic material and the recesses in the end of the heddle shaft facing its bare-lying fourth side will be conically extended. The end loop is thereby firmly secured due to the plastic material which grips into the conical recesses. This off-center arrangement of the end loop allows keeping it narrower in order to achieve a higher density.

The off-center arrangement of the end loop also makes possible a press-button-like connection between a separately manufactured end loop and the end of the heddle shaft if, for the purpose of attaching into conically extending bores in the end of the heddle shaft, the end loop is provided with certain parts which are bored through in the center so that, due to the through-bore, these parts are elastically yielding and, like a press-button, can be pressed into the bores in the end of the heddle shaft.

Furthermore, in order to secure the end loop firmly at the end of the heddle shaft, the heddle shaft can be displaced several times stepwise transversely to the direction of the heddle axis so that it lies free alternately on one or the opposite side of the end loop.

Further details and advantages of the invention can be seen from the following description and drawings in which the various features of the heddle are shown by way of example.

DETAILED DESCRIPTION OF THE INVENTION

Figure 1:
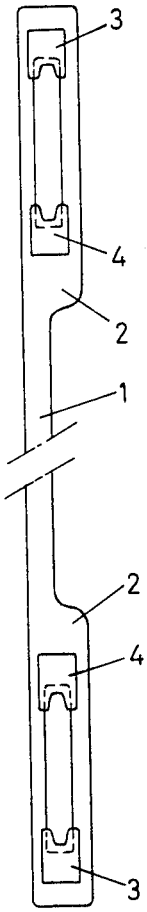
FIG. 1 is a side view of the upper and lower end loop with inside coatings of plastic material at opposite loop ends of a heddle according to the invention.

The heddle according to FIG. 1 has a heddle shaft 1 and end loops 2 which, as shown, are of one piece and made of flat steel. It is, however, possible to attach a separate end loop, in a known manner, to a heddle shaft of flat steel or of thin wire. However, in accordance with the invention, end loop 2 is coated with plastic material on the inside of loop ends 3 and 4 lying at the heddle axis, i.e., those areas coming in contact with the heddle carrying rods and on which, without the plastic material, a contact of metal-on-metal would occur and the hitting of the end loop on the edge of the heddle carrying rod would produce noise.

Figure 2:
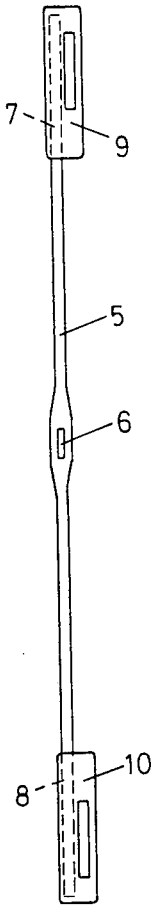
FIG. 2 is a side view of a further heddle of the invention in smaller scale with two end loops made of plastic material.
Figure 3:
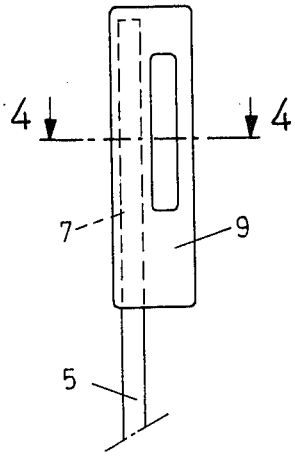
FIG. 3 is an enlarged side view of the upper end loop according to FIG. 2.
Figure 4:
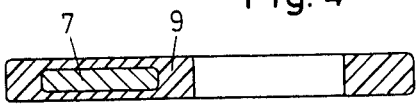
FIG. 4 is a cross-sectional view at an enlarged scale of the end loop taken substantially along line 1—1 of FIG. 3, the heddle shaft being made of flat steel.

FIG. 2 shows a complete heddle comprising a heddle shaft 5 having an eye 6 which takes up the warp yarn, ends 7 and 8 thereof being respectively connected to end loops 9 and 10 made of plastic material. Ends 7 and 8 respectively extend over the length of end loops 9 and 10 and lie adjacent the outer edge thereof in the direction of the heddle axis. In FIGS. 3 and 4, it can be seen that the plastic material of end loop 9 encloses end 7 of the heddle shaft on all sides. The end loop may be injected or molded onto the end of the heddle shaft.

Figure 5:
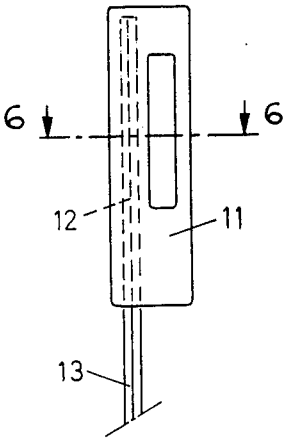
FIGS. 5, 7, 9, 11, 13, 15, 18, 20 and 22 are side views similar to FIG. 3 and show various types of connections between a heddle shaft of flat steel and the end loop.
Figure 6:
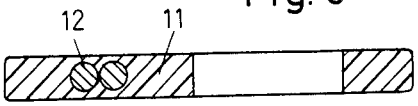
FIGS. 6, 8, 10, 14, 16, 17, 19, 21 and 23 are sectional views, at an enlarged scale, taken substantially along lines 6—6, 8—8, 10—10, 14—14, 16—16, 17—17, 19—19, 21—21 and 23—23, respectively.

End loop 11, shown in FIGS. 5 and 6 is connected in the same manner (i.e., injection or molding) to an end 12 of a twin wire heddle shaft 13.

Figure 7:
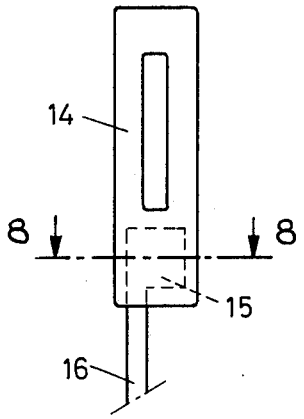
Figure 8:
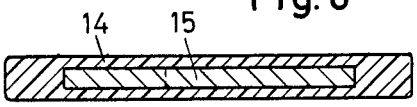
Figure 10:
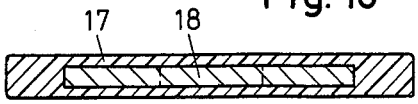

End loop 14 shown in FIG. 7 is connected to an enlarged end 15 of heddle shaft 16, end 15 extending only into the lower part of the end loop so that this end loop can be kept narrower than the end loops described earlier. And, it can be seen in FIG. 8 that the plastic material of the end loop completely encloses the assymetrically enlarged end 15 of the heddle shaft.

Figure 9:
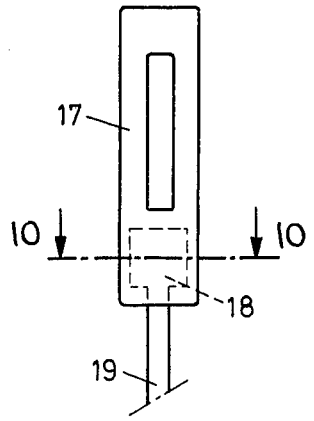

The end loop 17 shown in FIG. 9 differs from the end loop shown in FIG. 7 only in that end 18 of heddle shaft 19 is symmetrically widened.

Figure 11:
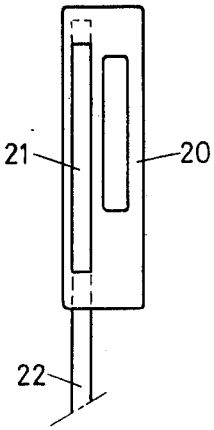
Figure 12:
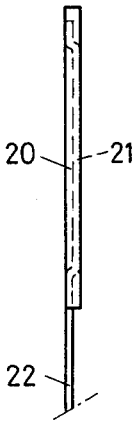
FIGS. 12 and 24 are end views of the interconnected shaft and end loop of FIGS. 11 and 22, respectively.

FIGS. 11 and 12 show a further alternative of connecting an end loop 29 to a reversely bent end 21 of a heddle shaft 22. It can be seen in FIG. 12 that end loop 20 has about double the thickness of heddle shaft 22, so that portions of end 21 lie in the same respective planes as opposing side surfaces of end loop 20. The end loop thus is better anchored to such a reversely bent end as compared to a straight end of the shaft.

Figure 13:
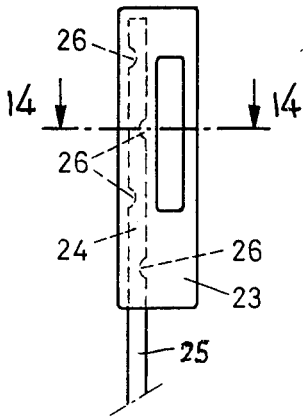
Figure 14:
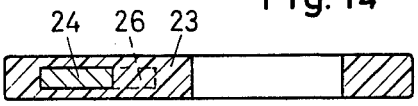

FIGS. 13 and 14 show a further alternative of anchoring an end loop 23 onto an end 24 of a heddle shaft 25. End 24 has notches 26 at regular intervals on its opposite side edges and these are filled with the plastic material of end loop 23 so that it has a good anchorage in the direction of the longitudinal axis of the heddle shaft.

Figure 15:
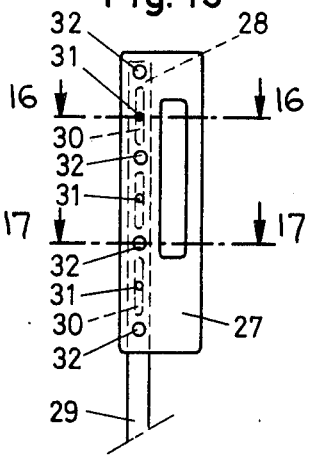
Figure 16:
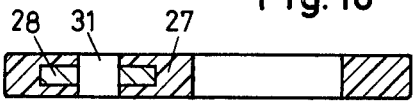
Figure 17:
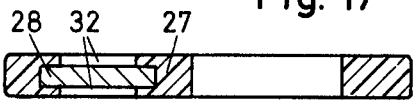

End loop 27 shown in FIGS. 15 to 17 is connected to an end 28 of heddle shaft 29 in a particularly preferred manner, end 28 having three adjacent slots 30 in the direction of the longitudinal axis and these slots being filled with the plastic material of the end loop. During the injection molding of the end loop onto the end of the heddle shaft several centering pins are used which leave cavities in the finished end loop. One of these three cylindrical cavities 31 is shown in FIG. 16 as passing completely through the plastic material of the end loop in the center of a slot 30.

This cavity is formed by one of the centering pins necessary for the perpendicular centering. In FIG. 17 it can be seen that additional cylindrical cavities 32, in all four each on the front and back of end loop 27 and at equal distances from each other, are formed by additional centering pins necessary for transverse centering so that end 28 of the heddle shaft is embedded exactly in the center of the plastic material of the end loop. The end loop therefore has the same wall thickness and strength on the front and back thereof.

Respecting the FIG. 15 embodiment, if the flat steel heddle has a thickness of 0.3 mm, the plastic material thickness of the end loop should exceed the heddle on the front and back side by approximately 0.2 mm, so that the end loop should total a wall thickness of 0.7 mm.

Figure 18:
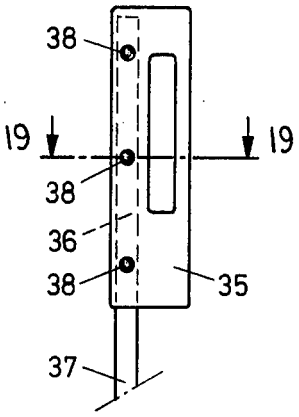
Figure 19:
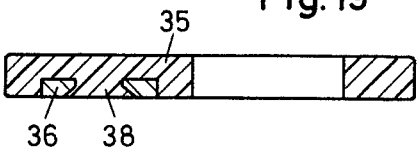

In order to obtain a narrower end loop it is expedient to place the end loop off-center at the end of the heddle shaft. An end loop 35, shown in FIGS. 18 and 19, is connected in such manner to an end 36 of a heddle shaft 37 having three bores 38 in end 36 at consecutive spaced intervals. As can be clearly seen in FIG. 19, these bores are widened conically toward the side of end 36 that is not enclosed in plastic material, but lies open. The plastic material filling bores 38 anchors the end loop at the end of the heddle shaft without it having to be enclosed by plastic material on opposing sides, thus permitting a narrower end loop.

Figure 20:
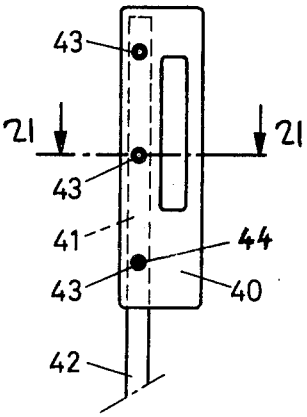
Figure 21:
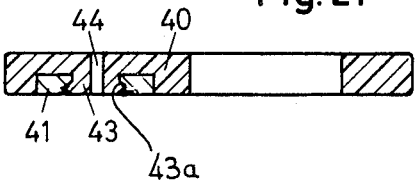

The embodiment show in FIGS. 20 and 21 is similar to that shown in FIGS. 18 and 19 except that an end loop 40 which is connected to an end 41 of a heddle shaft 42 is additionally bored through as at 44 in conical plugs 43 provided in the end loop. Bores 44 permit end loop 40 and end 41 to be snap fitted together when the plugs are inserted into corresponding bores **43*a* of end 41**. Thus, a separately manufactured end loop can be detachably mounted at the end of the heddle shaft.

Figure 22:
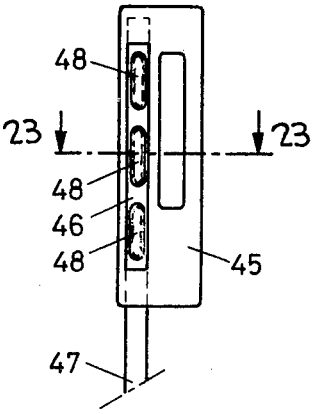
Figure 24:
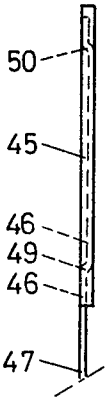
Figure 23:
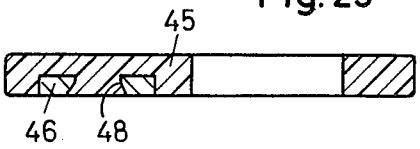

In a still further embodiment shown in FIGS. 22 to 24 of end loop 45 arranged off-center at an 46 of a heddle shaft 47, instead of the conically widening bores, slots 48 are provided in end 46. These slots extend conically toward the free-lying side of the end of the heddle shaft, as can be seen in FIG. 23. Thus, a combination with the type of anchoring of the end loops at the end of the heddle shaft as shown in FIGS. 11 and 12 is made possible, whereby end 46, as shown in FIG. 24, is reversely bent as at 49 in the lower region and as at 50 in the upper region of the end loop.

Figure 25:
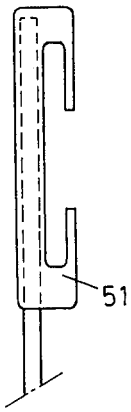
Figure 26:
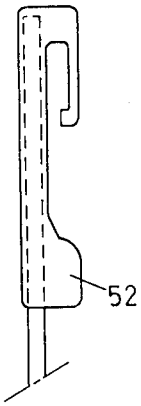

Also, the end loops connected to the ends of the heddle shaft in any one of the above described embodiments may have closed O-shaped eyelets therein or open C-shaped eyelets therein as shown at 51 for the end loop in FIG. 25. Or the end loops may have J-shaped eyelets therein as shown at 52 for the end loop in FIG. 26.

Many other modifications and variations of the present invention are made possible in the light of the above teachings. It is therefore to be understood that within the scope of the appended claims the invention may be practiced otherwise than as specifically described.

I claim:

1. A weaving heddle including a metal shaft and at least one end loop secured to one end of said metal shaft, said one end of said metal shaft having openings therein at consecutive spaced intervals in the direction of the shaft axis, and said end loop being of a plastic material and being formed by injection moulding, said openings in said metal shaft being occupied by the plastic material for anchoring said end loop in place on said end of said metal shaft.

2. The weaving heddle according to claim 1, wherein said openings are in the form of spaced slots, said end loop of plastic material completely surrounding said one end of said metal shaft, said end loop having centering pin cavities extending completely therethrough at said slots, the plastic material completely occupying said slots minus areas defining said cavities for anchoring said end loop in place on said one end.

3. The weaving heddle according to claim 1, wherein said openings are in the form of spaced conical bores occupied by the plastic material, said one end of said metal shaft having a side surface co-planar with a side surface of said end loop whereby said one end lies off-center relative to said end loop and the plastic material surrounds the remainder of said one end, and said bores being so disposed that the larger ends thereof are co-planar with said side surfaces.

4. The weaving heddle according to claim 1, wherein said openings are in the form of spaced conical bores, said end loop having spaced plugs thereon in engagement with said bores, said plugs having openings therein and being complementary in shape to that of said bores to facilitate snap fit between said plugs and said bores, said one end of said metal shaft having a side surface co-planar with a side surface of said end loop whereby said one end lies off-center relative to said end loop and the plastic material surrounds the remainder of said one end.

5. The weaving heddle according to claim 1, wherein said one end of said metal shaft is reversely bent and has opposing side surfaces co-planar respectively with opposing side surfaces of said end loop.

* * * * *